US012624464B2

(12) United States Patent
Becker et al.

(10) Patent No.: US 12,624,464 B2
(45) Date of Patent: May 12, 2026

(54) ELECTROLYSIS DEVICE

(71) Applicants: Primetals Technologies Germany GmbH, Erlangen (DE); Mitsubishi Heavy Industries Ltd., Tokyo (JP)

(72) Inventors: Gerd Becker, Marloffstein (DE); Christian Bergins, Datteln (DE); Torsten Gerhard Buddenberg, Moers (DE)

(73) Assignees: Primetals Technologies Germany GmbH (DE); Mitsubishi Heavy Industries Ltd. (JP)

( * ) Notice: Subject to any disclaimer, the term of this patent is extended or adjusted under 35 U.S.C. 154(b) by 547 days.

(21) Appl. No.: 18/197,356

(22) Filed: May 15, 2023

(65) Prior Publication Data

US 2023/0374675 A1 Nov. 23, 2023

(30) Foreign Application Priority Data

May 18, 2022 (EP) ..... 22174135

(51) Int. Cl.
*C25B 9/73* (2021.01)
*C25B 1/04* (2021.01)
*C25B 9/65* (2021.01)

(52) U.S. Cl.
CPC ..... *C25B 9/73* (2021.01); *C25B 1/04* (2013.01); *C25B 9/65* (2021.01)

(58) Field of Classification Search
None
See application file for complete search history.

(56) References Cited

U.S. PATENT DOCUMENTS

2010/0012503 A1* 1/2010 Hinatsu ..... C25B 1/02 204/278
2013/0140171 A1 6/2013 Hinatsu et al.
(Continued)

FOREIGN PATENT DOCUMENTS

CN 113445070 A 9/2021
FR 2114043 A5 6/1972

OTHER PUBLICATIONS

European Search Report, dated Jan. 9, 2023, issued in corresponding European Patent Application No. 22174135.8.

*Primary Examiner* — Louis J Rufo
(74) *Attorney, Agent, or Firm* — OSTROLENK FABER LLP

(57) ABSTRACT

An electrolysis device includes two electrolysis units, which each includes two end plates. The electrolysis units each includes an intermediate plate approximately or exactly in the middle between its end plates and each includes a stack of series-connected electrolysis cells between the intermediate plates and the end plates. Each stack of electrolysis cells includes two electrodes, at which an electrolysis liquid is partially electrolytically split, so that the remaining electrolysis liquid is admixed with a respective electrolysis gas in the area of the two electrodes after the electrolytic splitting. The end plates are electrically connected to one another at least in pairs. The electrolysis device includes a rectifier unit, which provides two potentials (P1, P2) via two outputs, each output being electrically connected to one terminal of the intermediate plate of the one electrolysis unit and to one terminal of the intermediate plate of the other electrolysis unit.

11 Claims, 2 Drawing Sheets

(56) References Cited

U.S. PATENT DOCUMENTS

| | | | | |
|---|---|---|---|---|
| 2024/0209533 | A1* | 6/2024 | Unru | C25B 15/06 |
| 2024/0344207 | A1* | 10/2024 | Höller | C25B 15/083 |
| 2025/0297381 | A1* | 9/2025 | Widuch | C25B 9/70 |

* cited by examiner

ELECTROLYSIS DEVICE

CROSS-REFERENCE TO RELATED APPLICATIONS

The present application claims priority to European Patent Application No. 22174135.8, filed May 18, 2022, the contents of which are incorporated by reference herein.

TECHNOLOGICAL AREA

The present invention is directed to an electrolysis device.

PRIOR ART

Electrolysis devices are known in various embodiments. Generally speaking, an electrolysis device comprises a number of electrolysis units. The number can be 1 or greater than 1. The electrolysis units each comprise a first and a second end plate. The electrolysis units often furthermore comprise an intermediate plate arranged between the first and the second end plate, sometimes also multiple intermediate plates. One of the intermediate plates can be arranged in the middle between the two end plates.

The electrolysis units include a stack of electrolysis cells between each two plates—in this case these can alternatively be the two end plates, one end plate and one intermediate plate, or two intermediate plates—wherein the electrolysis cells of the respective stack are electrically connected in series. The electrolysis cells each include a first electrode and a second electrode, at which an electrolysis liquid is electrolytically split, so that the electrolysis liquid is admixed after the electrolytic splitting with a first electrolysis gas in the area of the respective first electrode and with a second electrolysis gas in the area of the respective second electrode. The electrolysis device furthermore includes a rectifier unit, which provides a first potential via a first output and a second potential via a second output.

Multiple such electrolysis devices are known from US 2010/0 012 503 A1. The electrolysis devices known from US 2010/0 012 503 A1 each include a single electrolysis unit. In one of these electrolysis devices (hereinafter: prior art 1), the first end plate is connected to the first output, the second end plate to the second output. An intermediate plate, which is in turn grounded, is arranged between the two end plates. In another of these electrolysis devices (hereinafter: prior art 2), an intermediate plate is also provided. The intermediate plate is connected to the first output. The two end plates are connected to the second output and are grounded. In still another of these electrolysis devices (hereinafter: prior art 3), the two end plates are connected to the first output. An intermediate plate, which is connected to the second output and is grounded, is arranged between the two end plates. In still another of these electrolysis devices (hereinafter: prior art 4), in addition to the two end plates, a total of three intermediate plates are provided. The two end plates and the middle of the three intermediate plates are connected to the second output and are grounded. The two remaining intermediate plates are connected to the first output. In still another of these electrolysis devices (hereinafter: prior art 5), in addition to the two end plates, a total of two intermediate plates are provided. One end plate and one intermediate plate are connected to the first output. The other end plate and the other intermediate plate are connected to the second output and are grounded. The interconnection is such that the intermediate plate connected to the first output is located between the two plates connected to the second output and vice versa the intermediate plate connected to the second output is also located between the two plates connected to the first output.

Furthermore, an electrolysis device (hereinafter: prior art 6) is also known, which comprises a first and a second electrolysis unit, wherein the first and the second electrolysis unit each comprise a first and a second end plate. In this electrolysis device, the electrolysis units do not include any intermediate plates, so that the stack of electrolysis cells extends from the first to the second end plate of the respective electrolysis unit. In this electrolysis device, the first end plate of the first electrolysis unit and the first end plate of the second electrolysis unit are electrically connected to one another and are grounded. The first output of the rectifier unit is connected to the second end plate of the first electrolysis unit, the second output of the rectifier unit is connected to the second end plate of the second electrolysis unit. Fittings for supplying and discharging electrolysis liquid (in the supply without electrolysis gas, in the discharge with one of the electrolysis gases in each case) are arranged in the area of the first end plates of the two electrolysis units.

SUMMARY OF THE INVENTION

So-called renewable energies are required to a significant extent in the context of the energy transition. One possibility for the storage of renewable energies is the electrolysis of water from electrical energy generated by photovoltaics, wind power, or in another environmentally friendly way. In electrolysis, water is split into oxygen and hydrogen, the hydrogen is separated and stored and can then be consumed at another location or used in a motor vehicle for its drive, for example. The associated electrolysis liquid is often an aqueous solution of potassium hydroxide (KOH), wherein the concentration is usually in the range between 20% and 30%. In some cases, other liquids are also used, in rare cases gases other than hydrogen and oxygen are also generated.

The electrolysis is—obviously—to be operated as energy efficiently as possible. One of the factors which influences the energy efficiency is the operating voltage provided by the rectifier unit (=the difference of the two potentials provided via the first and the second output). In general, the losses within the rectifier unit are essentially proportional to the switched current, but relatively independent of the switched operating voltage. Increasing the operating voltage while maintaining the switched current therefore contributes to an improved energy balance.

The voltage (cell voltage) required for a single electrolysis cell is determined by the materials used in this electrolysis cell for the electrodes and the electrochemical processes occurring in the context of the electrolysis. The cell voltage is generally in the range of a few volts. To be able to use higher operating voltages (several hundred volts), therefore correspondingly many electrolysis cells have to be connected in series.

However, losses also arise during the operation of an electrolysis unit. The associated heat has to be discharged from the electrolysis unit. The discharge of the occurring losses essentially takes place through the electrolysis liquid. When the number of electrolysis cells of a respective stack is increased, the transport paths for the electrolysis liquid lengthen. The removal of the heat thus becomes more difficult. It is therefore not possible to increase the number of electrolysis cells of a respective stack arbitrarily.

Furthermore, the end plates are to be at ground potential if possible. On the one hand, touch safety thus results entirely on its own. Furthermore, greatly varying problems are thus avoided, which arise upon the connection of the lines guiding the electrolysis liquid (with or without electrolysis gas) to the media fittings, if they have a potential different from ground potential.

The solutions of the prior art each address only parts of the above-mentioned problems:

In prior art 1, both end plates are not grounded. Furthermore, the entire voltage drops in a single electrolysis unit, so that only a relatively low operating voltage can be used, since otherwise the thermal losses cannot be discharged.

In prior art 2, the two end plates are grounded. However, only a relatively small operating voltage can be used, since otherwise the thermal losses cannot be discharged.

In prior art 3—as in prior art 1—both end plates are not grounded. Furthermore, the entire voltage drops in a single electrolysis unit, so that only a relatively low operating voltage can be used.

In prior art 4, the two end plates are grounded. However, only a single electrolysis unit is used, so that only a relatively low operating voltage can be used.

In prior art 5, only one of the two end plates is grounded, so that a supply and discharge of the electrolysis liquid without problems is only possible at this end plate. Furthermore, the entire voltage drops in a single electrolysis unit, so that only a relatively low operating voltage can be used.

In prior art 6, two electrolysis units are provided, which are electrically connected in series. Therefore, a relatively high operating voltage can be used, since the drop of the operating voltage is distributed onto both electrolysis units. In both electrolysis units, however, only one end plate is grounded in each case. The fittings for supplying and discharging the electrolysis liquid are only arranged in the area of these end plates. Therefore, the operating voltage can only be increased relatively slightly in prior art 6, since otherwise the thermal losses connected thereto can no longer be discharged.

The object of the present invention is to provide possibilities by means of which the problems of the prior art are completely avoided.

The object is achieved by an electrolysis device having the claimed features. Advantageous embodiments of the electrolysis device are the subject matter of dependent claims.

According to the invention, an electrolysis device is created, in which

- the electrolysis device comprises a first and a second electrolysis unit,
- the first and the second electrolysis unit each comprise a first and a second end plate,
- the first and the second electrolysis unit each include a respective intermediate plate arranged approximately or exactly in the middle between the respective first and the respective second end plate,
- the first and the second electrolysis unit each include a stack of electrolysis cells between the respective intermediate plate and each of the two respective end plates,
- the electrolysis cells of the respective stack are each electrically connected in series,
- the electrolysis cells each include a first electrode and a second electrode, at which an electrolysis liquid is partially electrolytically split, so that the remaining electrolysis liquid is admixed after the electrolytic splitting with a first electrolysis gas in the area of the respective first electrode and with a second electrolysis gas in the area of the respective second electrode,
- the first end plate of the first electrolysis unit and the first end plate of the second electrolysis unit are electrically connected to one another,
- the second end plate of the first electrolysis unit and the second end plate of the second electrolysis unit are electrically connected to one another,
- the electrolysis device includes a rectifier unit, which provides a first potential via a first output and a second potential via a second output, and
- the first output of the rectifier unit is electrically connected to a terminal of the intermediate plate of the first electrolysis unit and the second output of the rectifier unit is electrically connected to a terminal of the intermediate plate of the second electrolysis unit.

In such an electrolysis device, it is first possible to operate at a high operating voltage from an electrical viewpoint. This is because the operating voltage can be distributed over the stack of electrolysis cells of two electrolysis units. Furthermore, one of the two potentials provided by the rectifier unit is not applied to any of the end plates. Therefore, a connection of the lines for the electrolysis liquid is possible without problems at all end plates. Therefore, the losses arising during operation can also be discharged via both end plates in each electrolysis unit, however, so that the number of electrolysis cells per stack and thus per electrolysis unit can be maximized.

The first and the second end plate of the first and the second electrolysis unit are preferably electrically connected to one another. This simplifies the operation of the electrolysis device still further. This is because independently of the specific potential of the end plates, the potential of the end plates is uniformly the same for all four end plates. It is particularly preferred in this case if the first and the second end plate of the first and the second electrolysis unit—whether directly for each end plate, or whether indirectly via one of the other end plates for at least one of the end plates—are electrically grounded.

The rectifier unit is preferably designed in such a way that it provides the first and the second potential without fixed reference to ground. This embodiment simplifies the design of the rectifier unit and furthermore also simplifies the operation of the electrolysis device as a whole. The decoupling of the rectifier unit from the ground potential may be achieved particularly easily in that a transformer unit is arranged upstream of the rectifier unit, via which the rectifier unit is supplied the electrical energy required for its operation.

The first and the second end plate of the first and the second electrolysis unit preferably include media fittings for supplying the electrolysis liquid, for discharging the electrolysis liquid admixed with the first electrolysis gas, and for discharging the electrolysis liquid admixed with the second electrolysis gas. The corresponding lines can thus be connected at both end plates of both electrolysis units and the heat discharge and the general operation of the electrolysis device can thus be optimized.

In some embodiments, the intermediate plates do not include passages for the electrolysis liquid, so that the flow direction of the electrolysis liquid is reversed at the respective intermediate plate. The two stacks of a respective electrolysis unit thus operate separately from one another in a fluidic aspect. Alternatively, it is possible that the intermediate plates only include passages for the electrolysis liquid (thus without electrolysis gases), but do not include passages for the electrolysis liquid admixed with the first electrolysis gas and the electrolysis liquid admixed with the second electrolysis gas. In this case, even with different pressure drops of the two end plates of a respective electrolysis unit to the intermediate plate of the respective electrolysis unit, the best possible flow through the electrolysis cells and a thus a good heat discharge take place. In a further alternative, it is possible that the intermediate plates include passages for both the electrolysis liquid and for the electrolysis liquid admixed with the first electrolysis gas and the electrolysis liquid admixed with the second electrolysis gas. At least the passages for the electrolysis liquid admixed with the first electrolysis gas and the electrolysis liquid admixed with the second electrolysis gas are separate from one another and separate from the passages for the electrolysis liquid as such (thus without electrolysis gases).

The first and the second electrolysis unit are preferably arranged adjacent to one another, so that the directions from the respective first end plate to the respective second end plate extend in parallel and, viewed in the mentioned directions, the first end plates are arranged at the same height and/or the second end plates are arranged at the same height. Not only is the required footprint as such thus minimized, but in addition short paths also result for the line guiding from the rectifier unit to the fittings of the intermediate plates. This applies in particular if the rectifier unit, viewed in the direction from the respective first end plate to the respective second end plate of a respective electrolysis unit, is located in front of the first end plates and, viewed orthogonally to the mentioned directions, is located in the area between the two sides of the two electrolysis units facing away from the respective other electrolysis unit. The optimization is particularly great if the fitting of the intermediate plate of the first electrolysis unit is arranged on the side of the first electrolysis unit facing toward the second electrolysis unit and vice versa the fitting of the intermediate plate of the second electrolysis unit is arranged on the side of the second electrolysis unit facing toward the first electrolysis unit.

The rectifier unit preferably includes transistors, in particular FETs or IGBTs, for switching the first and second potential at the first and the second output. Optimized operation of the rectifier unit thus results.

BRIEF DESCRIPTION OF THE DRAWINGS

The above-described properties, features, and advantages of this invention and the manner in which they are achieved will become clearer and more comprehensible in conjunction with the following description of the exemplary embodiments, which are explained in more detail in conjunction with the drawings. In the schematic figures.

DESCRIPTION OF THE EMBODIMENTS

Figure 1:
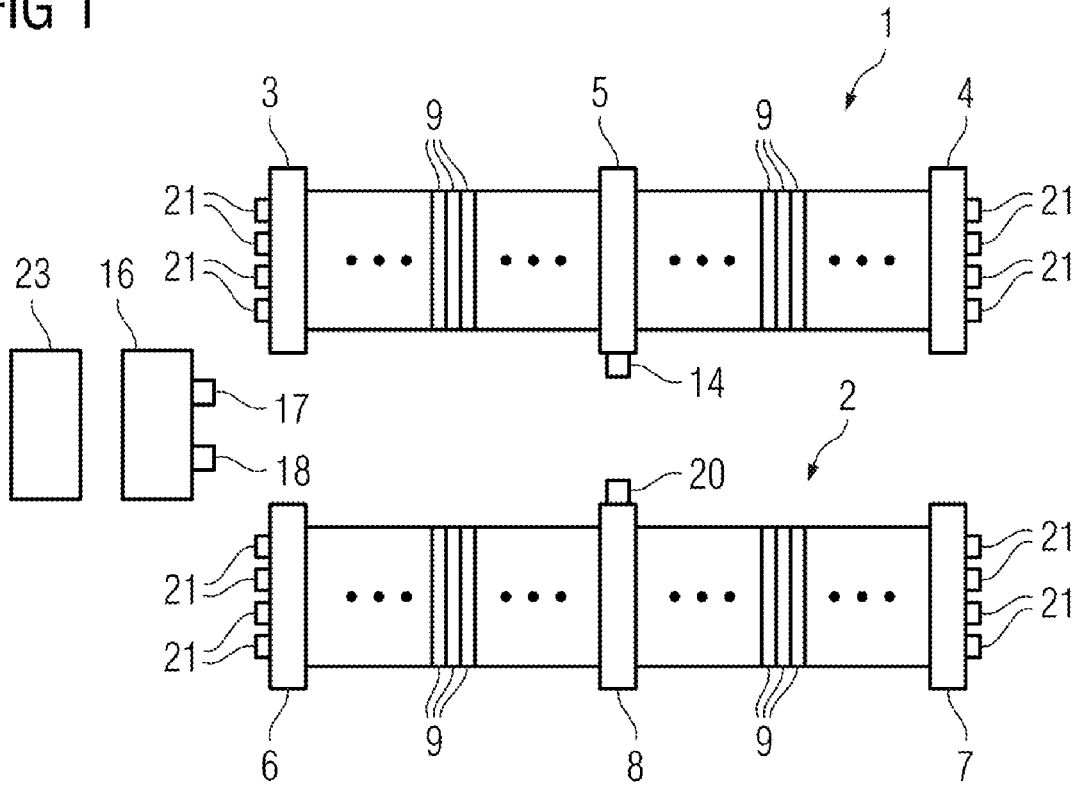
FIG. 1 shows an electrolysis device from above.

According to FIG. 1, an electrolysis device comprises a first electrolysis unit 1 and a second electrolysis unit 2. The first electrolysis unit 1 comprises a first end plate 3 and a second end plate 4 and an intermediate plate 5—approximately or exactly—in the middle between the two end plates 3, 4. The second electrolysis unit 2 analogously comprises a first end plate 6 and a second end plate 7 and an intermediate plate 8—approximately or exactly—in the middle between the two end plates 6, 7.

The electrolysis device furthermore comprises four stacks of electrolysis cells 9. One of the stacks extends in each case

- from the intermediate plate 5 of the first electrolysis unit 1 to the first end plate 3 of the first electrolysis unit 1,
- from the intermediate plate 5 of the first electrolysis unit 1 to the second end plate 4 of the first electrolysis unit 1,
- from the intermediate plate 8 of the second electrolysis unit 2 to the first end plate 6 of the second electrolysis unit 2, and
- from the intermediate plate 8 of the second electrolysis unit 2 to the second end plate 7 of the second electrolysis unit 2.

Figure 2:
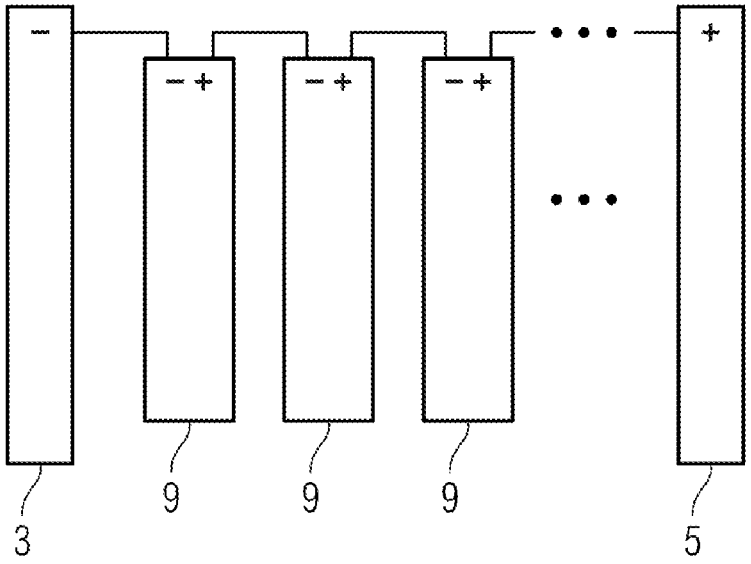
FIG. 2 shows an electrical interconnection of a stack of electrolysis cells.

The electrolysis cells 9 of the stacks are each—within the respective stack—electrically connected in series. This is shown in FIG. 2 for the stack which extends from the intermediate plate 5 of the first electrolysis unit 1 to the first end plate 3 of the first electrolysis unit 1. Analogous states of affairs apply to the other stacks.

Figure 3:
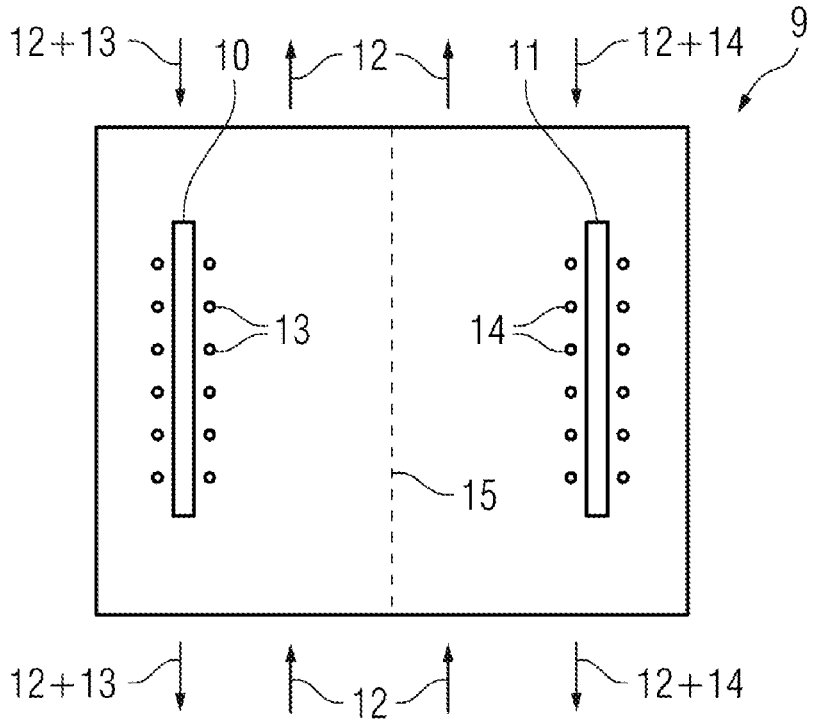
FIG. 3 shows the structure of a single electrolysis cell.

The electrolysis cells 9 themselves each include, according to FIG. 3, a first electrode 10 and a second electrode 11. An electrolysis liquid 12 is pumped through the electrolysis cells 9. The electrolysis liquid 12 is electrolytically split at the electrodes 10, 11. A first electrolysis gas 13 and a second electrolysis gas 14 arise due to the splitting. Membranes 15 are usually arranged in the electrolysis cells 9, which are permeable to ions contained in the electrolysis liquid 12, but not to the electrolysis gases 13, 14. The construction and the mode of operation of the electrolysis cells 9 is generally known to those skilled in the art. The electrolysis liquid 12 is typically an aqueous solution of potassium hydride and the electrolysis gases 13, 14 are hydrogen and oxygen. However, the present invention is not restricted in principle to this specific embodiment.

The electrolysis liquid 12 is only partially split. The remaining electrolysis liquid 12 is admixed with the first electrolysis gas 13 in the area of the first electrode 10 and with the second electrolysis gas 14 in the area of the second electrode 11 due to the splitting at the electrodes 10, 11.

Insofar as explained up to this point, the structure of the electrolysis device is conventional in nature and therefore does not have to be explained in more detail.

Figure 4:
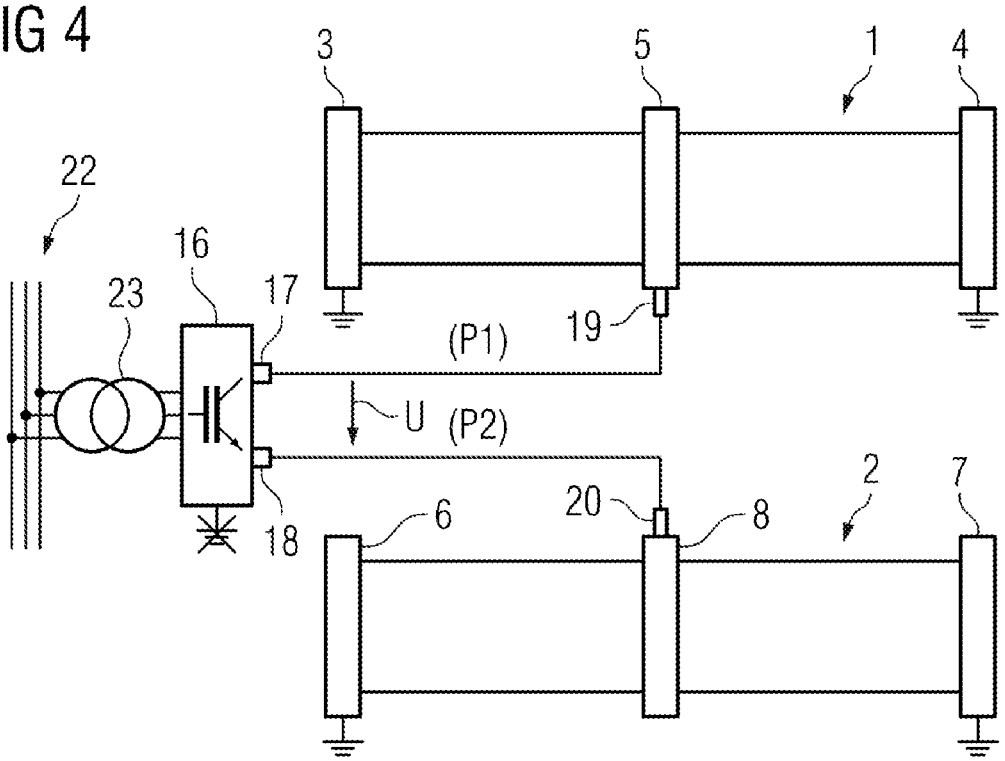
FIG. 4 shows a functional interconnection of the electrolysis device of FIG. 1.

According to FIG. 4—this represents a minimal configuration—on the one hand, the first end plates 3, 6 of the two electrolysis units 1, 2 are electrically connected to one another and, on the other hand, the second end plates 4, 7 of the two electrolysis units 1, 2 are electrically connected to one another. Preferably, all four end plates 3, 4, 6, 7 are electrically connected to one another. In particular, the four end plates 3, 4, 6, 7 can be electrically grounded.

The electrolysis device furthermore includes a rectifier unit 16. The rectifier unit 16 provides a first potential P1 via a first output 17 and provides a second potential P2 via a second output 18. The rectifier unit 16 is preferably designed in such a way that it provides the potentials P1, P2 without fixed reference to ground. This is indicated in FIG. 4 in that a grounding symbol is crossed out at the rectifier unit 16. Furthermore, the rectifier unit 16 according to the illustration in FIG. 4 preferably includes transistors for switching the first and the second potential P1, P2 at the first and the second output 17, 18. The transistors can be, for example, FETs or IGBTs.

The potentials P1, P2 have different values from one another. Their difference thus defines an output voltage U of the rectifier unit 16, which also represents the operating voltage of the electrolysis device at the same time. The first output 17 of the rectifier unit 16 is electrically connected to a terminal 19 of the intermediate plate 5 of the first electrolysis unit 1. Analogously, the second output 18 of the rectifier unit 16 is electrically connected to a terminal 20 of the intermediate plate 8 of the second electrolysis unit 2.

The electrolysis liquid 12 has to be supplied to the electrolysis units 1, 2. Furthermore, the electrolysis liquid 12 admixed with the two electrolysis gases 13, 14 has to be discharged—separately for both electrolysis gases 13, 14—from the electrolysis units 1, 2 again. For this purpose, per electrolysis unit 1, 2, in each case at least one of their end plates 3, 4, 6, 7 includes media fittings 21. According to the illustration in FIG. 4, preferably even both end plates 3, 4, 6, 7 of both electrolysis units 1, 2 include the corresponding media fittings 21.

At least three media fittings 21 are provided per end plate 3, 4, 6, 7 having media fittings 21, namely one each for the supply of the electrolysis liquid 12, the discharge of the electrolysis liquid 12 admixed with the first electrolysis gas 13, and the discharge of the electrolysis liquid 12 admixed with the second electrolysis gas 14. Four media fittings 21 can possibly also be provided. In this case, a separate supply of the electrolysis liquid 12 takes place for the area of the first electrodes 10 and the area of the second electrodes 11.

The intermediate plates 5, 8 can include passages for the passage of the electrolysis liquid 12 (with and without electrolysis gases 13, 14). At least the passages for the electrolysis liquid 12 admixed with the first electrolysis gas 13 and the electrolysis liquid 12 admixed with the second electrolysis gas 14 are separate from one another, however, and separate from the passages for the electrolysis liquid 12 as such (thus without electrolysis gases 13, 14). Alternatively, the intermediate plates 5, 8 do not include such passages. The flow direction of the electrolysis liquid 12 is thus reversed at the respective intermediate plate 5, 8, so that it initially flows from one of the end plates 3, 4, 6, 7 to the relevant intermediate plate 5, 8 and then flows back to the same end plate 3, 4, 6, 7. Alternatively, the intermediate plates 5, 8 can only include passages for the electrolysis liquid 12 (thus without electrolysis gases 13, 14), but no passages for the electrolysis liquid 12 admixed with the first electrolysis gas 13 and the electrolysis liquid 12 admixed with the second electrolysis gas 14.

The rectifier unit 16 has to be supplied with the electrical energy required for its operation. This preferably takes place from a supply network 22. Independently of the type of the supply, however, a transformer unit 23 is preferably arranged upstream of the rectifier unit 16. The supply network 22, the transformer unit 23, and the rectifier unit 16 (the latter only on the input side) are preferably designed as three-phase. However, this is not absolutely required.

According to the illustration in FIG. 1, the first and the second electrolysis unit 1, 2 are arranged adjacent to one another. The directions from the respective first end plate 3, 6 to the respective second end plate 4, 7 thus extend in parallel. Viewed in these directions, the first end plates 3, 6 are preferably arranged at the same height. Alternatively or additionally (the latter is preferred), the two end plates 4, 7 can also be arranged at the same height.

The rectifier unit 16 is preferably arranged in front of the electrolysis units 1, 2. Specifically, this means that the rectifier unit 16, viewed in the direction from the respective first end plate 3, 6 to the respective second end plate 4, 7 of a respective electrolysis unit 1, 2, is located in front of the first end plates 3, 6 and, viewed orthogonally to the mentioned directions, is located in the area between the two sides of the two electrolysis units 1, 2 facing away from the respective other electrolysis unit 2, 1.

Furthermore, the terminal 19 of the intermediate plate 5 of the first electrolysis unit 1 is preferably arranged on the side of the first electrolysis unit 1 facing toward the second electrolysis unit 2. Analogously, the terminal 20 of the intermediate plate 8 of the second electrolysis unit 2 is preferably arranged on the side of the second electrolysis unit 2 facing toward the first electrolysis unit 1.

The present invention has many advantages. In particular, a simple and superior operation of the electrolysis device results in both a fluidic aspect and in an electrical engineering aspect, which is additionally also energy-efficient.

Although the invention was illustrated and described in more detail by the preferred exemplary embodiment, the invention is not thus restricted by the disclosed examples and other variants can be derived therefrom by a person skilled in the art without leaving the scope of protection of the invention.

LIST OF REFERENCE SIGNS

1, 2 electrolysis units
3, 4, 6, 7 end plates
5, 8 intermediate plates
9 electrolysis cells
10, 11 electrodes
12 electrolysis liquid
13, 14 electrolysis gases
15 membrane
16 rectifier unit
17, 18 outputs
19, 20 terminals
21 media fittings
22 supply network
23 transformer unit
P1, P2 potentials
U output voltage

The invention claimed is:

1. An electrolysis device, wherein the electrolysis device comprises a first and a second electrolysis unit, wherein the first and the second electrolysis unit each comprises a first and a second end plate, wherein the first and the second electrolysis unit each includes a respective intermediate plate arranged between the respective first and the respective second end plate, wherein the first and the second electrolysis unit each includes a stack of electrolysis cells between the respective intermediate plate and each of the two respective end plates, wherein the electrolysis cells of each stack of electrolysis cells are electrically connected in series, wherein the electrolysis cells of each stack of electrolysis cells include a first electrode and a second electrode at which an electrolysis liquid is partially electrolytically split, so that the remaining electrolysis liquid is admixed after the electrolytic splitting with a first electrolysis gas in the area of the respective first electrode and with a second electrolysis gas in the area of the respective second electrode, wherein the first end plate of the first electrolysis unit and the first end plate of the second electrolysis unit are electrically connected to one another, wherein the second end plate of the first electrolysis unit and the second end plate of the second electrolysis unit are electrically connected to one another, wherein the electrolysis device includes a rectifier unit, which provides a first potential (P1) via a first output and provides a second potential (P2) via a second output, and wherein the first output of the rectifier unit is electrically connected to a terminal of the intermediate plate of the first electrolysis unit and the second output of the rectifier unit is electrically connected to a terminal of the intermediate plate of the second electrolysis unit.

2. The electrolysis device as claimed in claim 1, wherein the first and the second end plate of the first and the second electrolysis unit are electrically connected to one another.

3. The electrolysis device as claimed in claim 2, wherein the first and the second end plate of the first and the second electrolysis unit are electrically grounded.

4. The electrolysis device as claimed in claim 3, wherein the rectifier unit provides the first and the second potential (P1, P2) without fixed reference to ground.

5. The electrolysis device as claimed in claim 4, wherein a transformer unit is arranged upstream of the rectifier unit, via which the rectifier unit is supplied with the electrical energy required for its operation.

6. The electrolysis device as claimed in claim 1, wherein the first and the second end plate of the first and the second electrolysis unit include media fittings for supplying the electrolysis liquid, for discharging the electrolysis liquid admixed with the first electrolysis gas, and for discharging the electrolysis liquid admixed with the second electrolysis gas.

7. The electrolysis device as claimed in claim 6, wherein the intermediate plates do not include passages for the electrolysis liquid, so that the flow direction of the electrolysis liquid is reversed at the respective intermediate plate, or only include passages for the electrolysis liquid, but do not include passages for the electrolysis liquid admixed with the first electrolysis gas and the electrolysis liquid admixed with the second electrolysis gas, or include passages for both the electrolysis liquid and the electrolysis liquid admixed with the first electrolysis gas and the electrolysis liquid admixed with the second electrolysis gas.

8. The electrolysis device as claimed in claim 1, wherein the first and the second electrolysis unit are arranged adjacent to one another, so that the directions from the respective first end plate to the respective second end plate extend in parallel and, viewed in the mentioned directions, the first end plates are arranged at the same height and/or the second end plates are arranged at the same height.

9. The electrolysis device as claimed in claim 8, wherein the rectifier unit, viewed in the direction from the respective first end plate to the respective second end plate of a respective electrolysis unit is located in front of the first end plates and, viewed orthogonally to the mentioned directions, is located in the area between the two sides of the two electrolysis units facing away from the respective other electrolysis unit.

10. The electrolysis device as claimed in claim 8, wherein the terminal of the intermediate plate of the first electrolysis unit is arranged on the side of the first electrolysis unit facing toward the second electrolysis unit, and the terminal of the intermediate plate of the second electrolysis unit is arranged on the side of the second electrolysis unit facing toward the first electrolysis unit.

11. The electrolysis device as claimed in claim 1, wherein the rectifier unit includes transistors, for switching the first and the second potential (P1, P2) at the first and the second output.

* * * * *